US005613287A

United States Patent [19]

St. Clair

[11] Patent Number: 5,613,287

[45] Date of Patent: Mar. 25, 1997

[54] METHOD FOR FORMING STRINGS OF POCKETED SPRINGS

[75] Inventor: Albert R. St. Clair, Lilburn, Ga.

[73] Assignee: Simmons Company, Atlanta, Ga.

[21] Appl. No.: 478,915

[22] Filed: Jun. 7, 1995

[51] Int. Cl.[6] ..... B68G 7/00

[52] U.S. Cl. ..... 29/91.1; 29/430; 29/451; 53/114

[58] Field of Search ..... 5/475, 477; 53/524, 53/114; 29/430, 451, 91, 91.1

[56] References Cited

U.S. PATENT DOCUMENTS

| | | | |
|---|---|---|---|
| 1,950,186 | 3/1934 | Lofman | 53/114 |
| 2,093,531 | 9/1937 | Werner | 53/114 |
| 2,647,671 | 8/1953 | McInerney | 53/114 |
| 3,668,816 | 6/1972 | Thompson | 53/114 |
| 4,234,983 | 11/1980 | Stumpf . | |
| 4,439,977 | 4/1984 | Stumpf . | |
| 4,854,023 | 8/1989 | Stumpf | 29/91 |
| 4,986,518 | 1/1991 | Stumpf . | |
| 5,438,718 | 8/1995 | Kelly et al. | 5/475 |

*Primary Examiner*—David P. Bryant
*Attorney, Agent, or Firm*—Jones, Day, Reavis & Pogue

[57] ABSTRACT

Methods and apparatus are provided for forming strings of springs enclosed within pockets having flat overlapping side seams avoiding problems with false loft in mattress construction.

6 Claims, 6 Drawing Sheets

METHOD FOR FORMING STRINGS OF POCKETED SPRINGS

BACKGROUND OF THE INVENTION

1. Field of the Invention

The present invention relates to spring assemblies for mattresses, cushions and the like and, more particularly, to new and improved methods and apparatus for forming strings of springs enclosed within pockets having flat overlapping side seams and which do not exhibit the disadvantageous condition encountered in prior art assemblies known as false loft.

2. Description of the Prior Art

Numerous techniques have evolved for constructing mattresses, cushions and the like. One such technique which has gained wide acceptance is known as Marshall construction. In this construction, an innerspring assembly comprises the core of the mattress or cushion and is manufactured from a plurality of springs, each individually encapsulated in a pocket of suitable fabric. The pockets of springs are preferably joined together in a string of predetermined length and are arranged in a closely packed array all with their longitudinal axes parallel one to another and with their ends defining a plane. In mattress construction, this array of pocketed springs is typically covered with a quilted foam and fabric pad thereby providing a sleeping surface.

Strings of pocketed coil springs have been manufactured in different ways. In an early method of manufacture, a suitable fabric was folded in half lengthwise and stitched transversely at regular intervals to define pockets into which springs were inserted. This method has largely been replaced in more recent times by a method which uses heat sensitive fabric and ultrasonic welding techniques instead of stitching. An example of strings of pocketed coil springs manufactured by this latter method is disclosed in U.S. Pat. No. 4,234,983, issued to Stumpf and assigned to the common assignee herein. As disclosed in U.S. Pat. No. 4,234,983, a string of pocketed coils is formed by ultrasonically welding the coils into discrete pockets by first folding a heat sensitive fabric in half lengthwise and applying welds transversely to the longitudinal axis of the fabric. Once the coil springs are inserted into the pockets, the pockets are welded closed along a seam running lengthwise of the coil string adjacent one end of the springs. Apparatus for manufacturing the foregoing strings of coils is disclosed, for example, in U.S. Pat. No. 4,439,977, also issued to Stumpf and assigned to the common assignee herein.

A disadvantage of strings of coil springs of the foregoing construction is that the seam running lengthwise of the coil string creates two flaps of excess fabric material at one end of the pocketed springs. Some excess material is necessary along the seam to provide for proper alignment of the string in manufacture and assure adequate strength of the associated welds. However, when the string of coils is arranged to define an innerspring mattress or cushion core, the excess material projecting outwardly of the springs creates a false firmness which is known in the art as "false loft" beneath the outer surface pad of the mattress or cushion. This false loft condition can cause undesirable and objectionable body depressions to form when a user lays on a mattress or cushion.

Attempts have been made to eliminate false loft by constructing a string of coil springs having a flat overlap side seam instead of a top seam. A machine for constructing such coil strings is disclosed, for example, in U.S. Pat. No. 4,986,518, also issued to Stumpf and assigned to the common assignee herein. However, such a machine has a complicated elevator mechanism for spring insertion which has proven to be unreliable under manufacturing conditions.

Accordingly, it has been found to be desirable to provide mattress or cushion constructions in which the innerspring assembly is enclosed within pockets having flat overlap side seams. In particular, it has been found to be desirable to provide such mattress or cushion constructions which do not exhibit false loft by virtue of excess pocketing material adjacent the ends of the coils. Furthermore, it has been found to be desirable to provide coil string assemblies for innerspring constructions which use less pocketing fabric material than has been required in previously known constructions.

Still further, it has been found to be desirable to provide apparatus for constructing pocketed coil strings which are housed within pockets having flat overlap side seams. Such apparatus has been found to be effective, efficient and reliable in use and is structured to be readily retrofitted with existing prior art equipment at an economical cost.

SUMMARY OF THE INVENTION

The present invention improves over the prior art by providing a new method and apparatus for constructing strings of fabric pocketed coils with the pockets having flat overlap side seams. The apparatus includes a fabric in-feed station wherein a fabric web is twice folded to define a tube having a first flap which overlaps a second flap on one side of the tube. In the apparatus, this tube is advanced to a next station at which a deflector separates the overlapped flaps. A coil inserter is then disposed between the separated flaps and a vertically compressed coil spring is inserted horizontally into an open side of the tube. The fabric tube with the compressed coil therein is next advanced to a second deflector which realigns the flaps in overlapping relation. At a next station an anvil supports the overlapping flaps whereupon the flaps are spot welded together. At the next station, transverse seams are welded between the coil springs creating a discrete, individual pocket for each coil. At a final station, a beater assembly strikes the pocketed compressed coils to rotate them in their pockets and allow them to expand longitudinally.

BRIEF DESCRIPTION OF THE DRAWINGS

The foregoing and other novel features of the invention will become apparent upon a reading of the following detailed description taken in conjunction with the accompanying drawings wherein.

DETAILED DESCRIPTION OF THE PREFERRED EMBODIMENT

Figure 1:
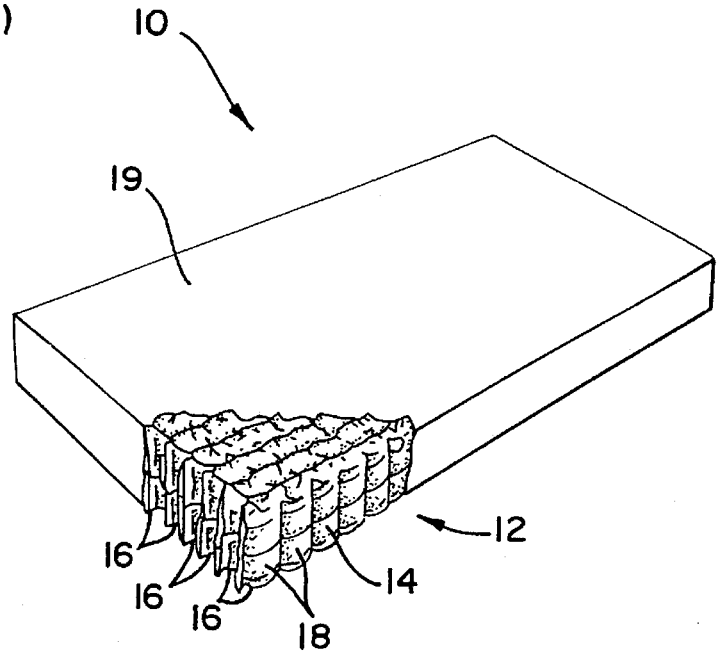
FIG. 1 (PRIOR ART)
FIG. 1 is a perspective view of a prior art mattress partially broken away to show a conventional innerspring construction.

Referring now to the drawings, and initially to FIG. 1, a mattress assembly of a type well-known in the art is designated generally by reference numeral 10 and includes an innerspring core assembly 12 of the so-called Marshall construction. The core 12 includes a string 14 of coils 16 within fabric pockets 18 arranged in a closely packed array having a generally rectangular shape in plan. For purposes of the present disclosure, the term coils may be used interchangeably with springs or coil springs. The coils 16 are all oriented with their longitudinal axes parallel to each other and with their ends all lying in a common plane. A suitable cover 19 is provided for the innerspring core 12 and is typically made of a quilted foam and/or fabric material defining a sleeping surface.

Figure 2:
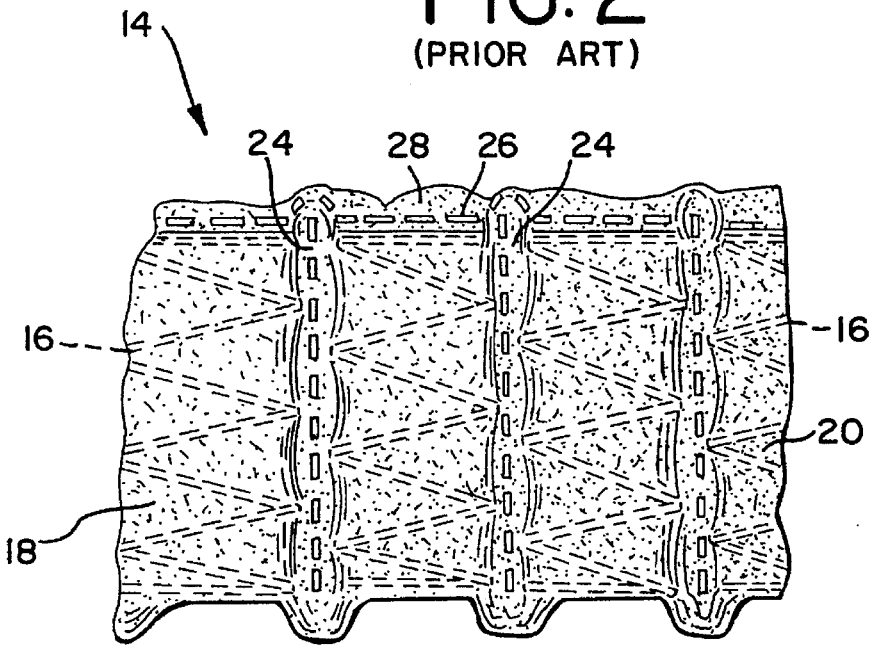
FIG. 2 (PRIOR ART)
FIG. 2 is a fragmentary side view of the prior art innerspring shown in FIG. 1.

Referring now to FIG. 2, a portion of the prior art string 14 of coils 16 enclosed within fabric pockets 18 is illustrated in side view and comprises a web of fabric 20 which is essentially folded in half lengthwise. The fabric is preferably heat sensitive and is formed into a series of spaced pockets by transverse welds 22. The welds 22 define webs 24 connecting the pockets to form a string 14 which can be of any preselected length. Because the fabric 20 is folded in half, a seam 26 is welded across the upper edge of the string 14, as viewed in FIG. 2, in order to close the pocket. This forms a pair of flaps 28, only one of which can be seen, running lengthwise of the string 14 above the plane defined by the upper ends of the coils 16. The flaps 28 are necessary to space the welds of the seam 26 inwardly of the edges of the fabric 20 and thereby assure adequate strength of the seam 26, as well as to provide for proper alignment of the string 14 in manufacture.

Figure 4:
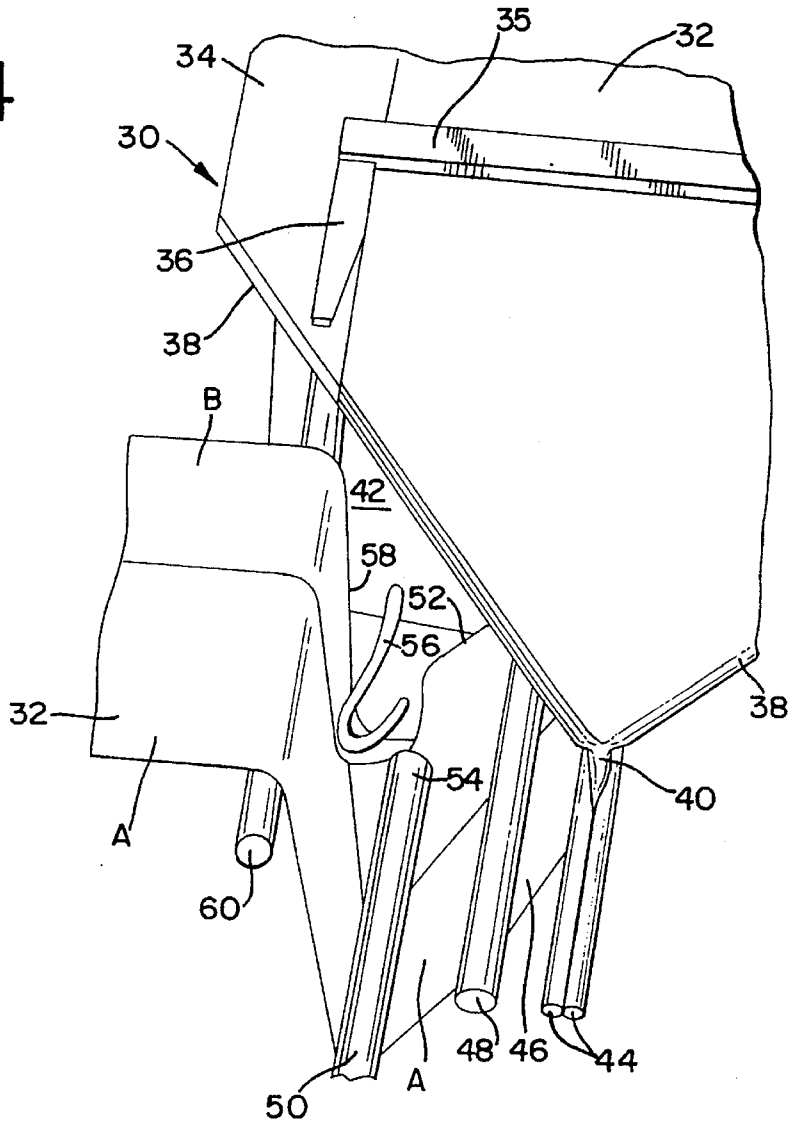
FIG. 4 is another partial perspective view of the in-feed station of FIG. 3 showing fabric being folded therein.
Figure 3:
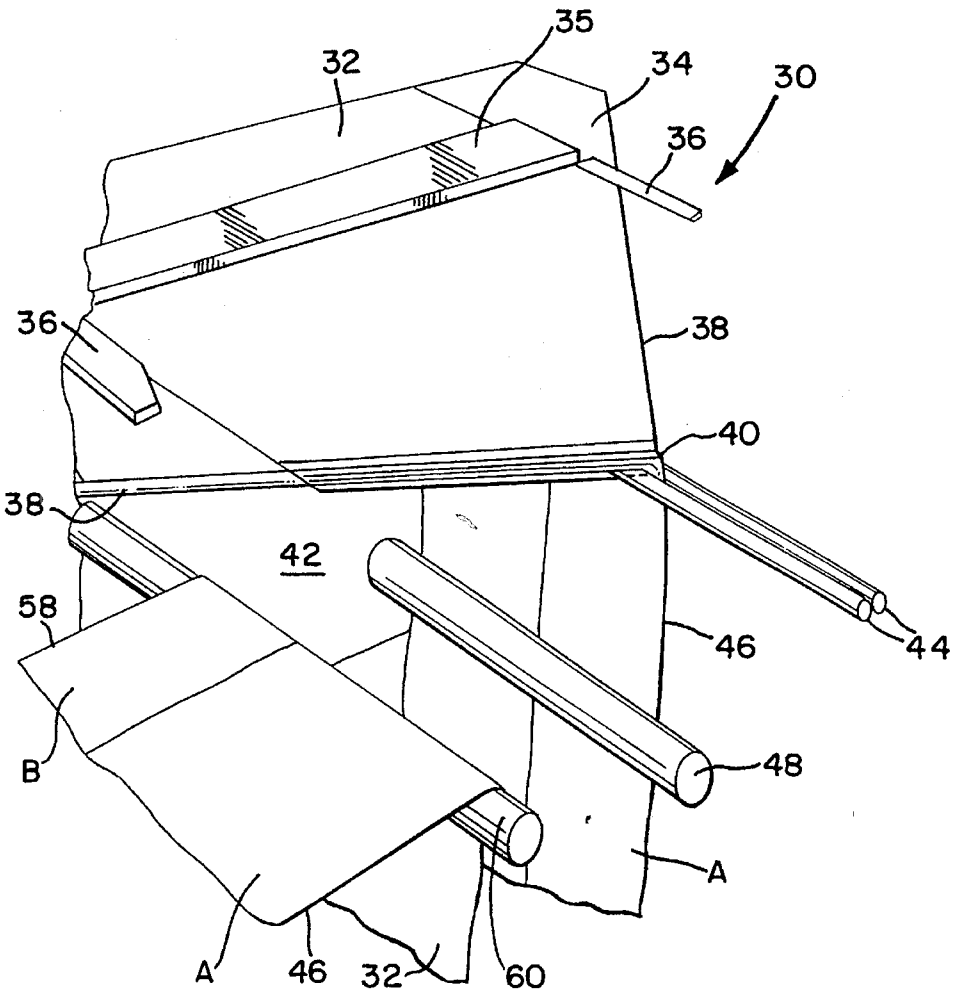
FIG. 3 is a partial perspective view of a fabric in-feed station of an apparatus in accordance with the present invention.

Turning now to FIGS. 3 and 4, a portion of an apparatus for constructing strings of pocketed coil springs 16 in accordance with the invention is designated generally by the reference numeral 30. As described hereinafter, the apparatus will be discussed in terms of its progressive sequences of operation, in the so-called apparatus direction, beginning with the portion 30 which is a pocket material in-feed station.

At the in-feed station 30, a web of heat sensitive fabric 32 is fed into the apparatus across a diamond-shaped folding plate 34. Preferably, the fabric 32 is of a non-woven polypropylene composition, for example, of a type sold under the trade name DUON. A guide bar 35 extends over the top of the fabric 32 in spaced relation to the folding plate 34 to assure that the fabric 32 will lay flat on the plate 34. Adjustable guide bars 36 are positioned along opposite edges of the fabric web 32 to properly align the fabric 32 for folding. The fabric 32 travels over edges 38 of the folding plate 34 which converge to a point 40. Beneath the plate 34 and extending from a frame member 42 are a pair of closely spaced parallel guide bars 44. The guide bars 44 are aligned with the point 40 of the folding plate and have a mounting structure which includes spring tensioning means (not shown) to urge them into closely spaced relation. The fabric 32 passes between the guide bars 44 and a first fold 46 in the fabric 32 is created defining a first flap which will be consistently designated hereinafter as flap A.

The web of fabric 32 next passes around an idler roller 48 which extends from and is journalled for rotation on the frame 42. As best seen in FIG. 4, the fabric 32 then passes around a second roller 50. This roller 50 is journalled on a frame member (not shown) which is disposed opposite to and spaced from frame 42. The roller 50 extends only a portion of the width of the folded fabric 32 creating a loose edge 52 of fabric 32 which passes around free end 54 of the second roller 50. A smoothly rounded hook member 56 extends from the frame 42 in proximity with the end 54 of the roller 50 and engages the loose edge 52 of fabric 32 causing the edge 52 to reversely turn over the web 32 and form a second fold 58. The second fold 58 creates a second flap which will be designated consistently hereinafter as flap B. The web 32 which has now been twice folded then passes over a third roller 60 which is journalled for rotation on the frame 42 and the web 32 exits the fabric in-feed station 30 in an essentially horizontal orientation.

Figure 5:
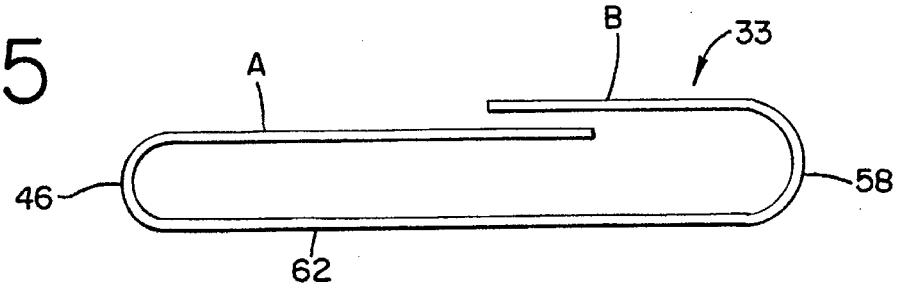
FIG. 5 is a schematic end view of a fabric tube constructed in accordance with the present invention.

The configuration of the fabric 32 after it leaves the in-feed station 30 is shown schematically in FIG. 5. The fabric 32 is formed into a fabric tube 33, preferably having an essentially flat tubular shape with flap A folded over a back portion 62 at first fold 46 and flap B folded over back portion 62 at second fold 58. In a preferred form, flap A is approximately six inches in width while flap B is approximately three inches in width. Also, flap B preferably overlaps flap A by approximately one-half inch. It can be appreciated that the width of flap A can be predetermined by the adjustable lateral alignment of the fabric Web 32 with respect to the point 40 of the folding plate 34. Moreover, the width of flap B can be predetermined by the suitable positioning of the second roller 50 and associated hook member 56.

Figure 6:
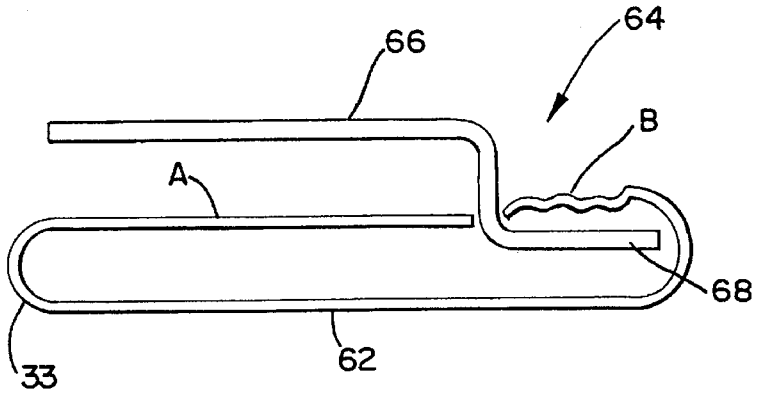
FIG. 6 is a schematic end view of a first deflector station of an apparatus in accordance with the present invention illustrating a stage in the inventive process wherein the flaps on a fabric tube are separated to expedite subsequent insertion of coil springs therein.

The fabric tube 33 advances next to a first deflector station shown schematically in FIG. 6 and designated generally by the reference numeral 64. A deflector arm 66 has a free end portion 68 which is configured for insertion beneath flap B and separates flap B from its overlapped relation with flap A. It will be understood by those skilled in the art that while not shown in FIG. 6 or subsequent figures, the apparatus of the present invention includes a suitable elongated table or plate for supporting the back side 62 of the fabric tube 33 throughout successive steps in the assembly process.

Figure 7:
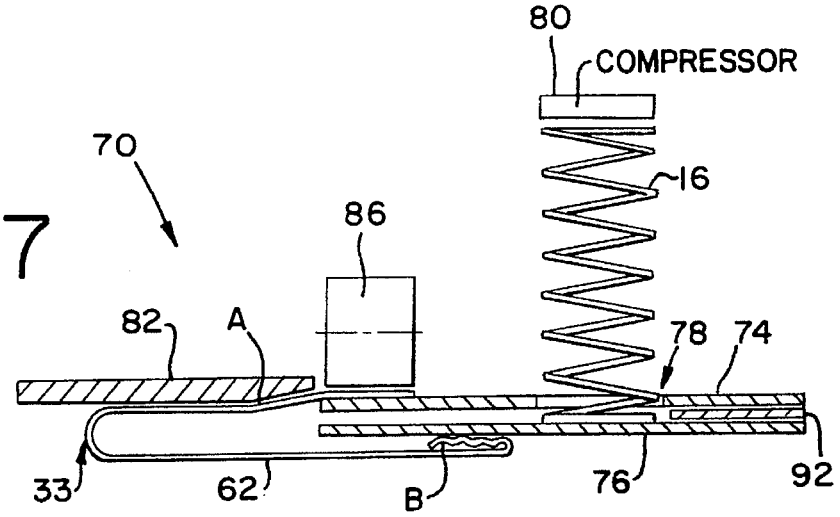
FIG. 7 is a schematic view of a spring insertion station in accordance with the present invention illustrating a stage in the inventive process wherein a spring, in an uncompressed state, is positioned prior to insertion into a fabric tube.

Next, the fabric tube 33 advances to a coil insertion station shown in FIG. 7 and designated generally by the reference numeral 70. A coil inserter assembly is designated as 72 and includes an upper plate 74 and a lower plate 76 arranged parallel to one another and spaced from one another by approximately three-eighths of an inch. Upper plate 74 has a circular opening 78 which is dimensioned to permit a coil spring 16 to pass through it and be supported on the lower plate 76 with the longitudinal axis of the spring 16 oriented vertically. It is to be noted that the spring 16 is transported to the inserter 72 in a fully extended state by any suitable transport means (not shown) and is positioned under a compressor 80 which is in vertical alignment with the opening 78 in the upper plate 74. The condition of the fabric tube 33 at this point is such that flap B is positioned to pass underneath the lower plate 76 of the inserter 72 while flap A passes under a support plate 82 and has edge portion 84 supported on the upper plate 74 of the inserter 72. The edge portion 84 of flap A is pressed firmly to the plate 74 by a tensioned roller 86.

Figure 8:
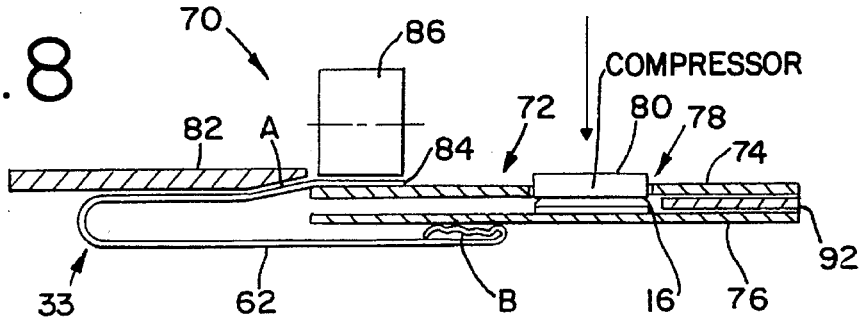
FIG. 8 is a schematic view of the spring insertion station of FIG. 7 showing the spring in a fully compressed state for insertion into a fabric flap.
Figure 9:
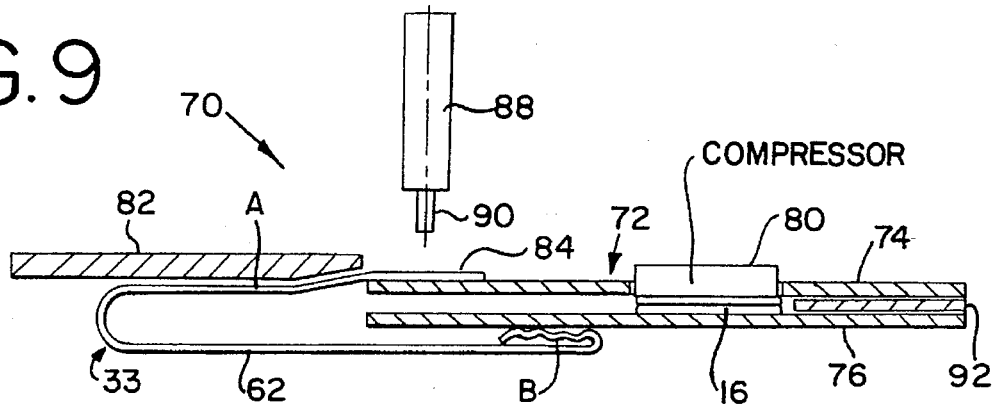
FIG. 9 is a further schematic view of the spring insertion station of FIG. 7 with the apparatus aligned for insertion of the fully compressed spring into the fabric tube.
Figure 10:
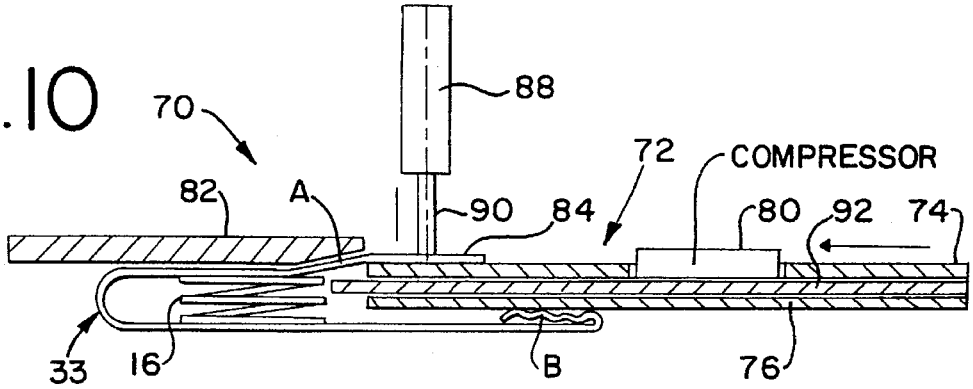
FIG. 10 is a schematic view of the spring insertion station of FIG. 7 showing the spring inserted into the fabric tube.

In FIG. 8, the spring 16 is shown in a compressed state upon activation of the compressor 80. FIG. 9 shows the next step of the coil insertion process wherein the fabric tube 33 is advanced in a manner such that edge portion 84 of flap A moves into registry with an air cylinder 88. Coil insertion is completed in the schematic view of FIG. 10 which shows ram 90 of the air cylinder 88 activated to hold the edge portion 84 of flap A firmly to the upper inserter plate 74 while a reciprocating air operated inserter bar 92 moves the compressed coil 16 horizontally from the compressor 80 to a position beneath flap A.

Figure 11:
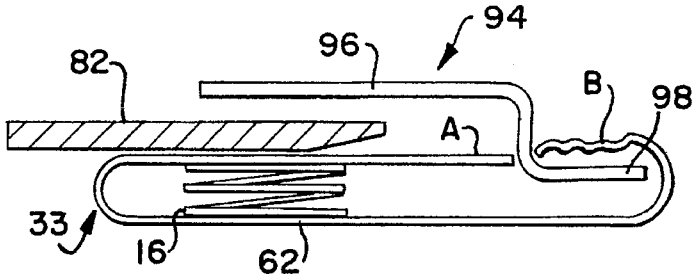
FIG. 11 is a schematic view of a second deflector station of an apparatus in accordance with the present invention illustrating a stage in the inventive process wherein the flaps on the fabric tube are returned to their original overlapped condition after spring insertion.

Once coil insertion is completed, the fabric tube 33 advances with the compressed coil 16 under support plate 82 to a second deflector station designated generally as 94 in FIG. 11. At this station 94, a second deflector arm 96 has a free end portion 98 which engages and lifts flap B to its original overlapped condition with respect to flap A.

Figure 12:
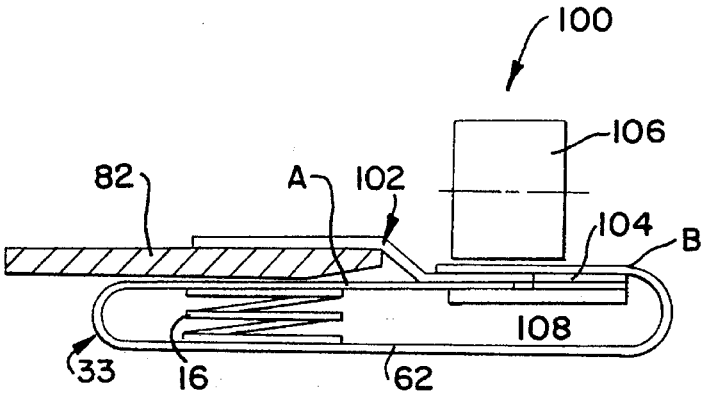
FIG. 12 is a schematic view illustrating apparatus for performing the next processing stage in accordance with the present invention wherein the flaps on the fabric tube are positioned for processing after insertion of a spring therein.

FIG. 12 illustrates apparatus 100 for performing the next step in the process of this invention wherein the fabric tube 33 is received by an anvil 102. The anvil 102 may be supported by plate 82 and includes a first upper arm 104 over which flap B passes. Flap B is pressed firmly into contact with arm 104 by a second tensioned roller 106. In this step of the process, flap A passes under the first anvil arm 104 and over the top of a second lower arm 108 which is suspended in a cantilevered manner from first arm 104. The anvil 102 is designed so that lower arm 108 also projects horizontally in the apparatus direction from beneath upper arm 104.

Figure 13:
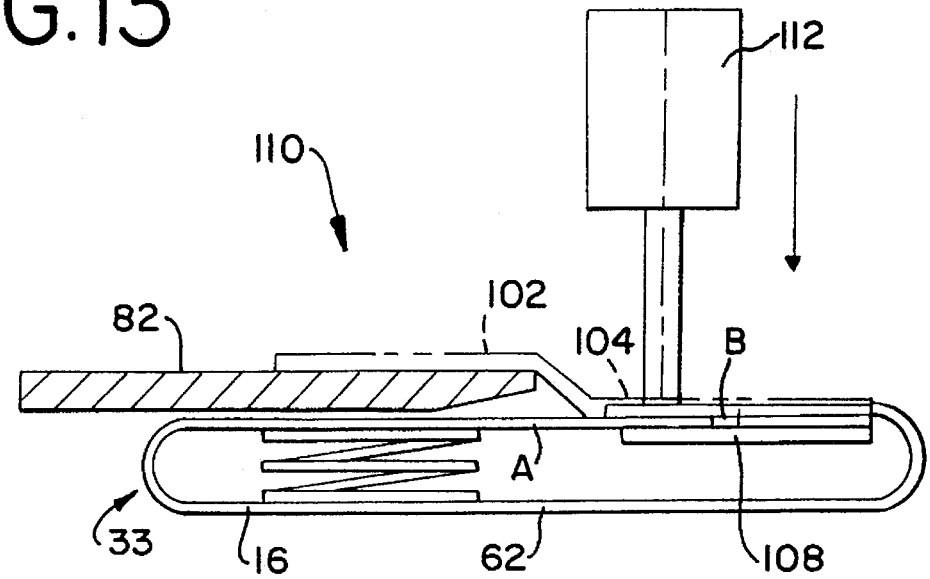
FIG. 13 is a schematic view of a first welding station of an apparatus in accordance with the present invention illustrating a stage in the inventive process wherein the flaps on the fabric tube are lap sealed.

Turning now to FIG. 13, a first welding station is designated generally by the reference numeral 110 and includes an ultrasonic spot welding horn 112. At this station 110, the fabric tube 33 has passed the upper arm 104 of the anvil 102 whereupon flap B returns to overlapped engagement with flap A, the two flaps being supported by lower arm 108 of the anvil 102. The welding horn 112 is next activated to place a spot weld on the lap between flap A and flap B, whereby a lap seal is formed.

Figure 14:
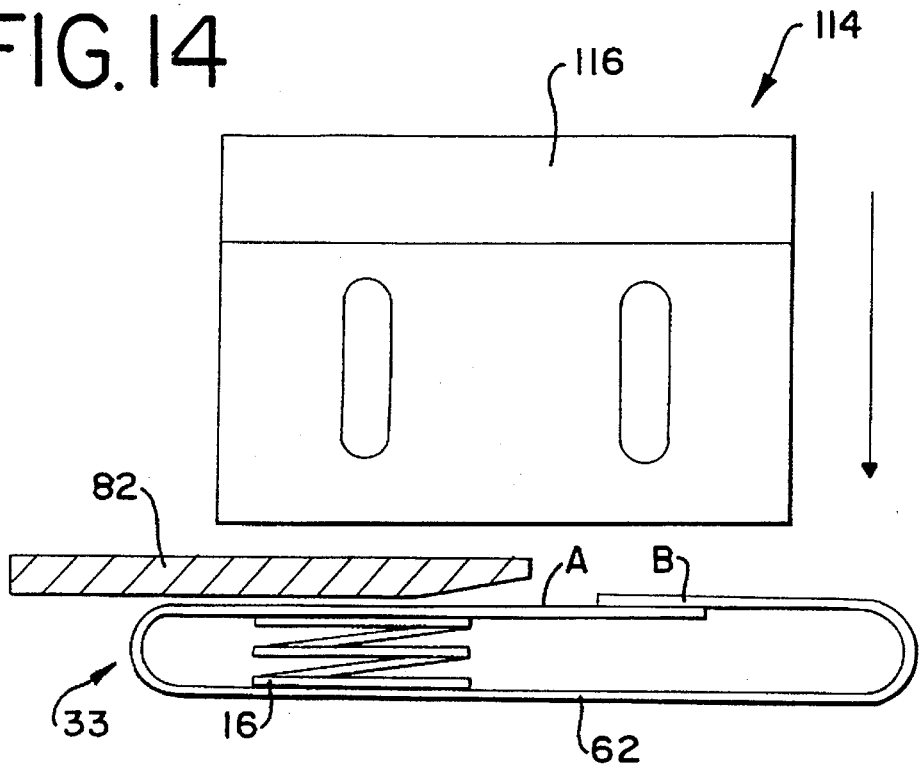
FIG. 14 is a schematic view of a second welding station of an apparatus in accordance with the present invention illustrating a stage in the inventive process wherein discrete fabric pockets with coil springs encapsulated therein.

In FIG. 14, a second welding station is designated by the reference numeral 114 and includes a second welding horn 116 which is oriented transversely to the fabric tube 33. In a manner well-known in the art, this second welding horn 116 is designed to form a linear series of spaced welds between the upper and lower sides of the fabric tube 33 intermediate successive coils 16 thereby forming a string 14 of discrete fabric pockets 18 with individual spring coils 16 encapsulated within each pocket.

Figure 15:
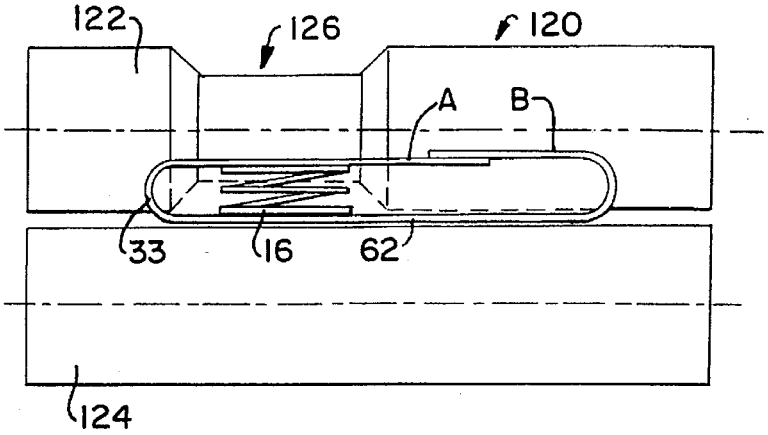
FIG. 15 is a schematic view of a drive station of an apparatus in accordance with the present invention illustrating a mechanism for drawing the fabric tube through the apparatus for processing.

FIG. 15 illustrates schematically a drive station 120 of the apparatus which comprises a pair of parallel closely spaced rollers 122 and 124. The rollers 122 and 124 are so tensioned together that they serve to draw the fabric tube 33 through the apparatus from the in-feed station 30 through all subsequent processing stations of the apparatus. A suitable recess 126 is formed in one of the rollers 122 or 124 so that the coil springs 16 can pass freely between the rollers 122 and 124.

Figure 16:
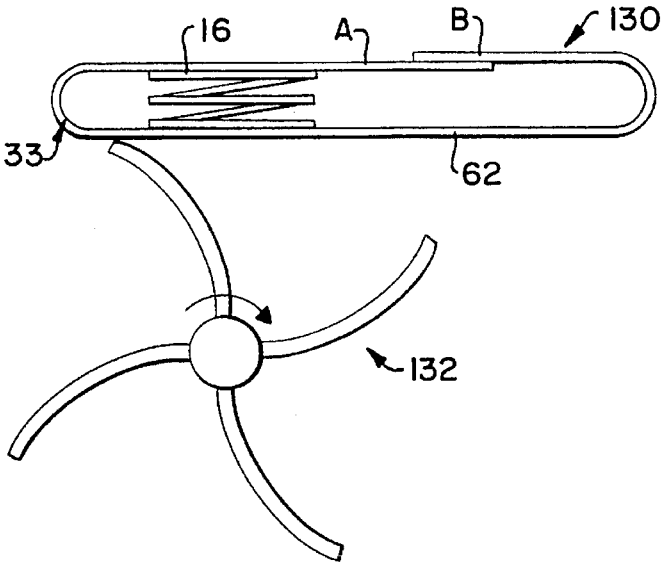
FIG. 16 is a schematic view of a final forming sattion of an apparatus in accordance with the present invention illustrating a mechanism for properly orienting the spring within a fabric pocket.

A final forming station is shown schematically in FIG. 16 and designated generally by the reference numeral 130. At this station 130 a rotating beater assembly 132 is provided with resilient arms 134 for striking the fabric tube 33 in the area of the pocketed coil springs 16. This striking action of the beater 132 causes the coil springs 16 to rotate ninety degrees within their pockets and to expand from their compressed state to an extended state, thereby filling the pocket 18.

Figure 17:
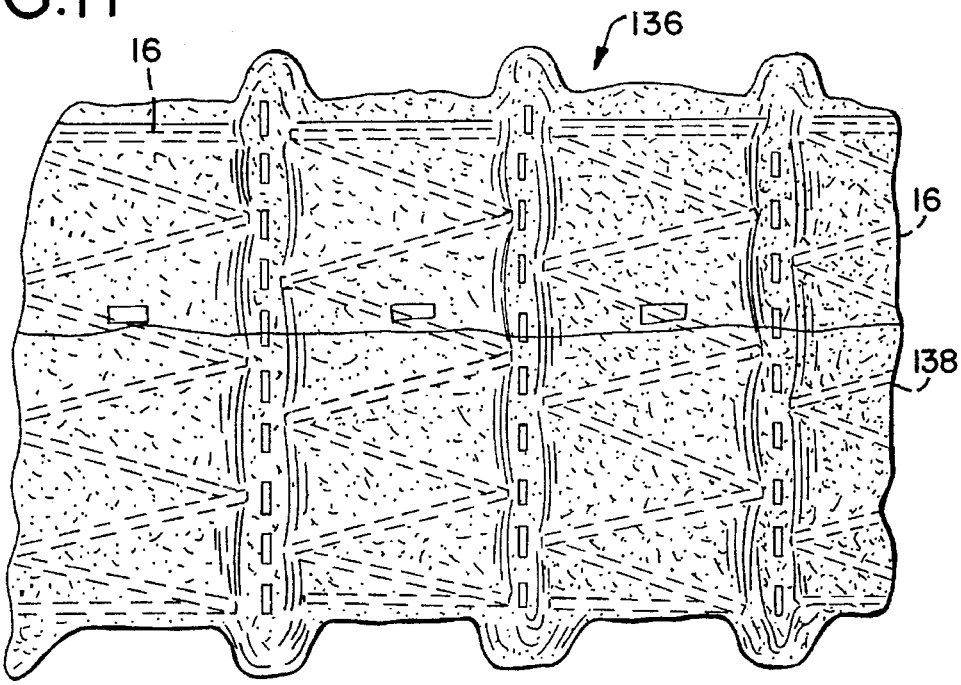
FIG. 17 is a fragmentary side view of a string of pocketed coils constructed in accordance with the present invention.

It can now be appreciated that the apparatus of the present invention is highly efficient and effective for constructing strings of pocketed coil springs which have the a seal formed along a side thereof instead of having a seal adjacent to the ends of the springs. A string of fabric pocketed coils 136 constructed with the present apparatus is illustrated in side view in FIG. 17. As seen therein, a flat overlap side seam 138 eliminates the two upper flaps 28 of the prior art string 14 shown in FIG. 2. Thus, the coil string 136 is highly desirable for use in a mattress innerspring assembly in that it eliminates objectionable false loft. It can also be appreciated that because the side seam 138 may overlap by only about one-half inch or so, savings in fabric 32 can be achieved over the prior art constructions which have two excess flaps 28. Further, the apparatus of the present invention may be readily configured from existing known equipment with the addition and/or replacement of a few parts and subassemblies. Accordingly, the invention lends itself to highly economical retrofitting of equipment currently in use.

While the present invention has been described in connection with a preferred embodiment thereof, it will be understood by those skilled in the art that many changes and modifications may be made without departing from the true spirit and scope of the invention. Accordingly, it is intended by the appended claims to cover all such changes and modifications which come within the true spirit and scope of the invention.

What is claimed is:

1. A method of forming a string of coil springs wherein each of the coil springs is enclosed within an individual fabric pocket having flat overlapping side seams, the method comprising the steps of:

folding an elongated web of fabric a first time to create a longitudinally extending first flap;

folding said web of fabric a second time to create a second longitudinally extending flap which overlaps said first flap laterally, thereby defining a fabric tube having a flap side and a back side with said second flap on said flap side laterally overlapping said first flap on said flap side;

conveying said fabric tube longitudinally across a first deflector member in a manner such that said first deflector member causes said second flap to deflect away from overlapping relationship with said first flap as said fabric tube is conveyed across said first deflector member thereby forming a laterally extending opening in said tube With said second flap on said flap side of said tube being displaced from overlapping relationship with said first flap on said flap side of said tube;

inserting a compressed coil spring into the opening between the first and second flaps on the flap side of the tube;

conveying said fabric tube across a second deflector member in a manner such that said second deflector member causes said second flap to be realigned into laterally overlapping relationship with said first flap as said fabric tube is conveyed longitudinally across said second deflector member; and interconnecting said laterally overlapping first and second flaps to form a lap seal therebetween.

2. The method of claim 1 including the step of forming transverse seams in said fabric tube between the coil springs to create discrete, individual pockets to accommodate said coil springs.

3. The method of claim 1 wherein said first flap is created by passing said web of fabric over edges of a diamond-shaped folding plate.

4. The method of claim 1 wherein said second flap is created by reversely turning an edge of said web around a hook member.

5. The method of claim 1 wherein said coil spring is compressed along an axis oriented at right angles to the longitudinal axis of said fabric tube, and said coil spring is inserted transversely to the longitudinal axis of said fabric tube.

6. The method of claim 1 including the further step of rotating said compressed coil spring within said pocket to allow said coil spring to expand within said pocket.

* * * * *